US006971952B2

(12) United States Patent
Whitty

(10) Patent No.: US 6,971,952 B2
(45) Date of Patent: Dec. 6, 2005

(54) SANDER

(75) Inventor: Ross Anthony Whitty, Diamond Beach (AU)

(73) Assignee: Whitbury Corporation Pty Ltd, Tuncurry (AU)

( * ) Notice: Subject to any disclaimer, the term of this patent is extended or adjusted under 35 U.S.C. 154(b) by 0 days.

(21) Appl. No.: 10/415,285

(22) PCT Filed: Nov. 9, 2001

(86) PCT No.: PCT/AU01/01453

§ 371 (c)(1),
(2), (4) Date: Jun. 27, 2003

(87) PCT Pub. No.: WO02/38333

PCT Pub. Date: May 16, 2002

(65) Prior Publication Data

US 2004/0029505 A1 Feb. 12, 2004

(30) Foreign Application Priority Data

Nov. 9, 2000 (AU) ..... PR1350

(51) Int. Cl.[7] ..... B24B 23/02
(52) U.S. Cl. ..... 451/357; 451/359; 451/453; 451/456
(58) Field of Search ..... 451/453, 456, 451/357, 359; 15/393, 398, 399, 403, 415.1; 144/252.1

(56) References Cited

U.S. PATENT DOCUMENTS 3,701,221 A 10/1972 Vinella
3,935,678 A * 2/1976 Marton ..... 451/359
4,071,981 A 2/1978 Champayne
4,697,389 A 10/1987 Romine
4,759,155 A 7/1988 Shaw
4,964,243 A 10/1990 Reiter
5,238,988 A * 8/1993 King et al. ..... 524/425
5,245,797 A 9/1993 Milkie (Continued)

FOREIGN PATENT DOCUMENTS

DE 297 06 298 6/1998

OTHER PUBLICATIONS

Shaw, C. J., Particle -collecting sander device- has negative pressure base secured to exteriorly-grooved cover overlaid by porous abrasive, 1988 Derwent Publications Ltd.

*Primary Examiner*—George Nguyen
(74) *Attorney, Agent, or Firm*—William J. Sapone; Henry Coleman; R. Neil Sudol

(57) ABSTRACT

A sanding tool 10 includes a block 11 mounting an abrasive member 50, and a shroud 12 which extends around the block and includes a channel 20 which is configured to receive abraded dust. The abrasive member is configured to project beyond an outer edge regions 16 of the shroud 12. The shroud further includes an outlet 21 which is connected to a source of suction, and at least one inlet 22 which is formed as an interruption in the edge regions 16 of the shroud 12. In use, when the sander is located on a planar surface, and suction is applied to the outlet, air is able to be drawn into the channel over the edge region of the peripheral wall and the inlet is configured to introduce a draft through said channel to facilitate clearing of abraded dust from the channel to the outlet.

23 Claims, 2 Drawing Sheets

U.S. PATENT DOCUMENTS 5,292,352 A * 3/1994 Rudolf et al. ..... 451/41
5,540,616 A 7/1996 Thayer
5,919,085 A * 7/1999 Izumisawa ..... 451/357
5,993,305 A 11/1999 Chu
6,027,399 A * 2/2000 Stewart ..... 451/353
6,224,471 B1 5/2001 Clowers et al.

* cited by examiner

FIG 4
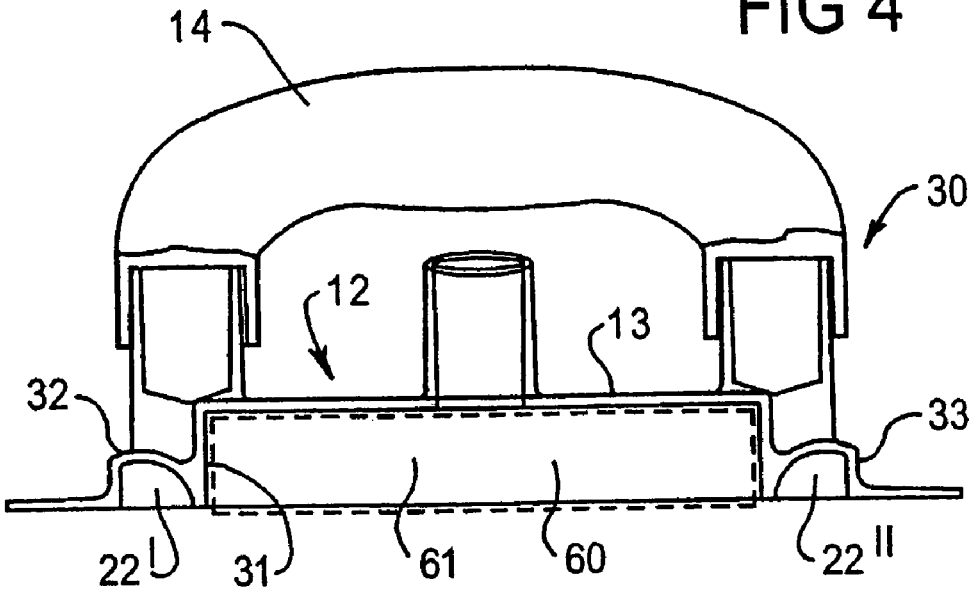
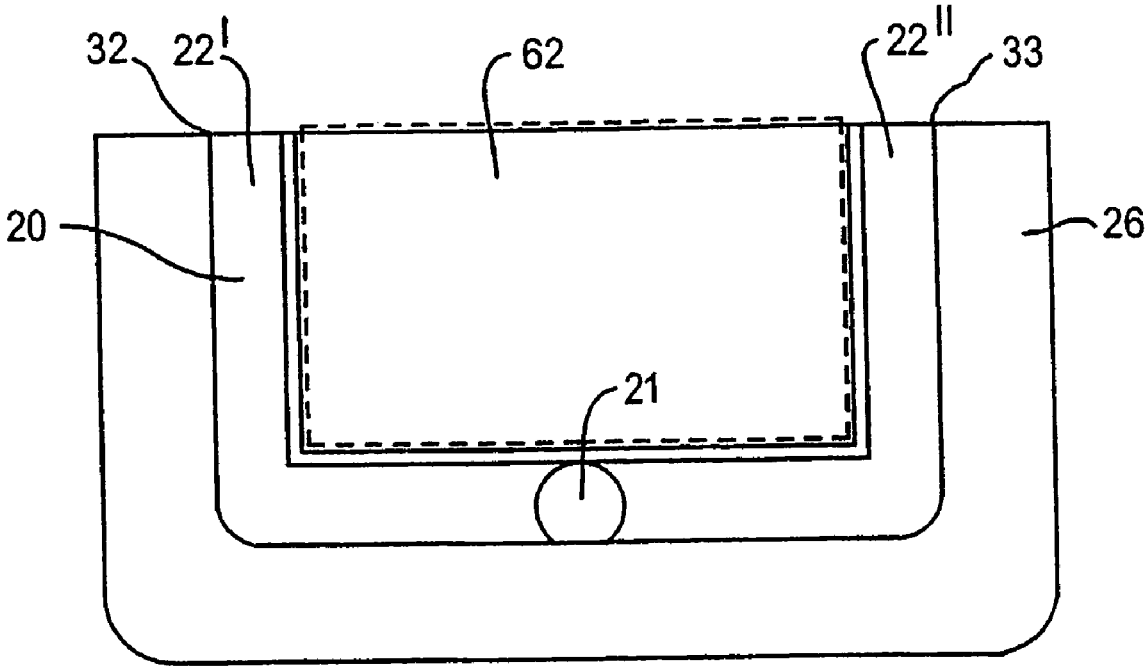
FIG 5

SANDER

FIELD OF THE INVENTION

The present invention relates to a sanding device for abrasively removing material from a surface. The invention has been designed especially, but not exclusively, for use in sanding plaster walls or ceilings and is herein described in that context.

BACKGROUND OF THE INVENTION

When using hand sanding tools to sand plaster and the like, the operator of the sander is subjected to dust problems particularly when sanding vertical or underhand surfaces where the operator is often showered with a massive amount of sanding dust. The dust is unpleasant and hazardous, and necessitates the operator wearing a dusk mask. Further, where plastering and sanding takes place in furnished or carpeted buildings, it is usually necessary to protect the flooring of that room and any furniture with dust sheets or the like.

To alleviate this problem, various systems have been proposed to control dust which include providing a shroud around the sander which is connected to a source of suction to collect the dust. Systems which incorporate this facility are described in U.S. Pat. Nos. 4,071,981, 4,697,389, 5,245,797 and 5,540,616.

In these earlier devices, the shroud has an outer peripheral edge which surrounds the abrasive material so that a channel is formed which is able to receive the abraded material generated by the abrasive member in use of the sander. The channel is in communication with a source of suction and the abrasive material is designed to sit proud of the peripheral edge so that air is able to be drawn into the channel around the periphery of the abrasive member.

Whilst the use of a shroud does remove a portion of the dust the effectiveness of the sander is not necessarily consistent around the peripheral of the abrasive member. This can lead to accumulation of dust in sections of the channel when sanding ceilings or the like which will lead to clogging of the sander, or dust escaping from the periphery when sanding vehicle surfaces.

SUMMARY OF THE INVENTION

An aim of the present invention is to provide an improved sanding tool which is designed to at least ameliorate the above problem so as to provide for more effective dust removal.

Accordingly, the present invention provides a sanding tool for sanding generally planar surfaces, the tool including a block adapted to receive, or including, an abrasive member; a shroud including a peripheral wall having an edge region which extends at least part way round said block, the peripheral wall being spaced from said block so that a channel is formed between said block and said peripheral wall which is configured to receive abraded dust generated by said abrasive member, the block being positioned relative to said shroud so that in use, the abrasive member projects beyond said edge region of said peripheral wall; at least one outlet located in said shroud and communicating with said channel, the at least one outlet being connectable to a source of suction; and at least one air inlet located in said shroud and communicating with said channel, wherein when the sander is located on a planar surface and suction is applied to the at least one outlet, air is able to be drawn into the channel over said edge region of said peripheral wall, and wherein the at least one inlet is configured to introduce a draft through said channel to facilitate clearing of abraded dust from the channel to the at least one outlet.

The advantage of the present invention is that the construction of the shroud provides for more effective air flow through the channel than previous devices. Specifically, the air is able to flow into the channel around its periphery of the shroud. In addition the air inlet enables a draft to be generated which facilitates clearing of the channels and provides better directional flow through the channels to the outlet.

In one form, the channel extends around the entire periphery of said block. Preferably, in this arrangement, the or each outlet is disposed on one side of said block, whereas the or each air inlet is disposed on an opposite side of said block. In another form, the channel only extends part way around said block so that the channel includes opposite ends. In this arrangement, preferably the outlet is located intermediate the ends, whereas inlets are disposed at the ends of said channel.

In one form, the or each air inlet is formed as an interruption in the edge region of said peripheral wall.

In a particularly preferred form, the channel includes a constricted region adjacent the or each air inlet. The advantage of this arrangement is that it cause air to accelerate through the air inlet which assists in dust removal towards the outlet. In a particularly preferred form, the shroud includes a recess disposed inwardly of said edge region and which defines at least part of the channel, and wherein the recess is shallower at the inlet to form the constricted region in the channel.

Preferably the clearance between the sanding face of the abrasive material and the edge of the shroud is between and 1 mm and 5 mm and more preferably between 2 mm or 3 mm. This clearance is provided to enable air flow into the channel as discussed above. Also, the clearance prevents the shroud impacting on the surface being sanded and/or sticking to the wall by forming a seal between the wall and the shroud. Also it should not be too large as it may cause dust to escape from through the clearance particularly when sanding vertical surfaces.

Preferably the outer edge region of the shroud includes a flange which extends outwardly generally in the plane parallel to the sanding plane of the abrasive member. This flange promotes directional flow of air across the edge region of the shroud. This assists in inhibiting dust escaping around the peripheral edge thereby further improving the effectiveness of the sander to collect and remove dust.

In one form, the sanding block may include a foam or other compressible backing sheet and the abrasive member is typically a sheet of sandpaper or the like. Preferably the shroud includes clamps which are designed to receive and secure the edges of the sandpaper when mounted on the block.

In another form, the sanding tool is designed for use as an internal sander. In this arrangement, the sanding tool is adapted to be used with a conventional cuboid sanding block. In this arrangement, the sanding tool includes a recess in which the sanding block is operative to locate. The sanding block is designed to project from this shroud so that the channel only extends part way around the block. In this arrangement, two contiguous faces of the sanding block are designed to sit proud of the shroud so as to enable the sanding block to access internal corners and the like.

The sanding tool may be utilised as a manual device. Alternatively, the sanding tool can incorporate an electric sander such as an orbital sander. In this arrangement, the shroud projects around the block of the electric sander and may be connected to or formed as an extension of the housing of the electric sander.

BRIEF DESCRIPTION OF THE DRAWINGS

It is convenient to hereinafter describe embodiments of the invention with reference to the accompanying drawings. It is to be appreciated that the particularity of the drawings and the related description is to be understood as not superceding the generality of the preceding broad description of the invention.

In the drawings:

FIG. 4 is a front elevation of a sanding tool according to a second embodiment of the present invention; and FIG. 5 is an underside view of the sanding tool of FIG. 4.

DETAIL DESCRIPTION OF THE PREFERRED EMBODIMENTS

Figure 1:
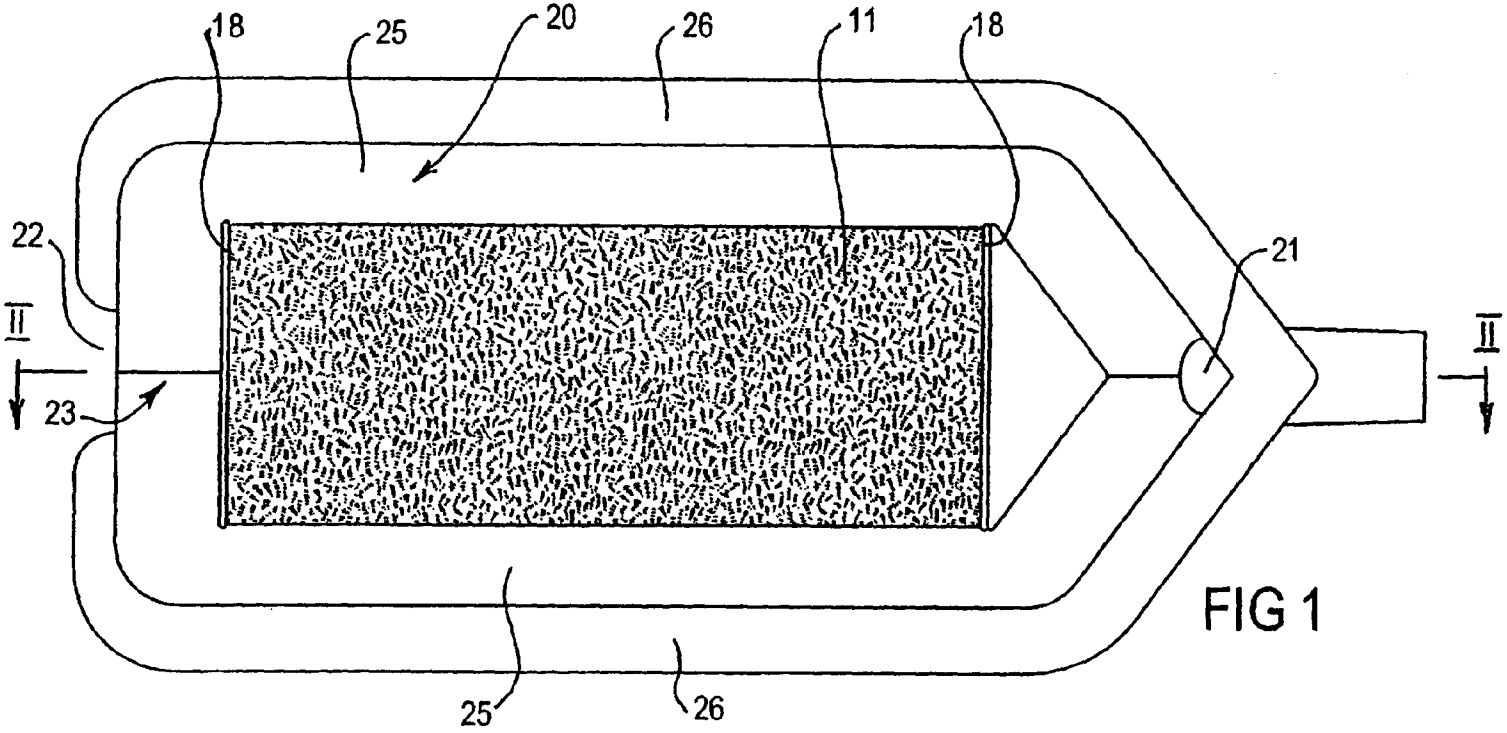
FIG. 1 is an underside view of a sanding tool according to a first embodiment of the present invention.
Figure 3:
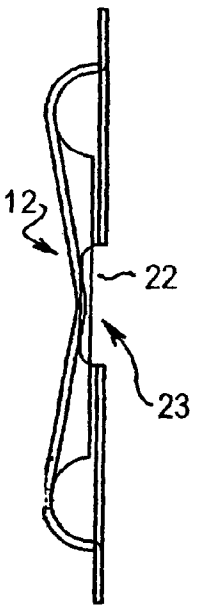
FIG. 3 is a front elevation of the sanding tool of FIG. 1.

Referring firstly to FIGS. 1 and 3, a sanding tool 10 includes a central sanding block 11 and a shroud 12 which in the illustrated arrangement is formed of plastic made by an injection moulding process. The shroud 12 includes a main body portion 13 incorporating a handle 14 on its upper face, and an outer peripheral wall 15 which has an outer edge region 16 which extends around the perimeter of the generally rectangular sanding block 11.

The sanding block 11 includes a layer of neoprene foam 17 on which a sheet of sandpaper 50 is able to be removably mounted. Slots 18 are formed in the body portion 13 of the shroud 12 along each of the shorter ends of the sanding block and are designed to receive the free end 51 of the sandpaper 50. Once passed through the slots 18, the free ends 51 are clamped to the main body 13 by clamps 19 mounted on the upper face of the main body.

The neoprene foam 17 projects beyond the edge region 16 of the peripheral wall 15. When sandpaper (having a thickness of about 0.5 mm) is mounted on the sanding block 11, the sandpaper is designed to project approximately 2 mm to 3 mm beyond the edge region 16.

Figure 2:
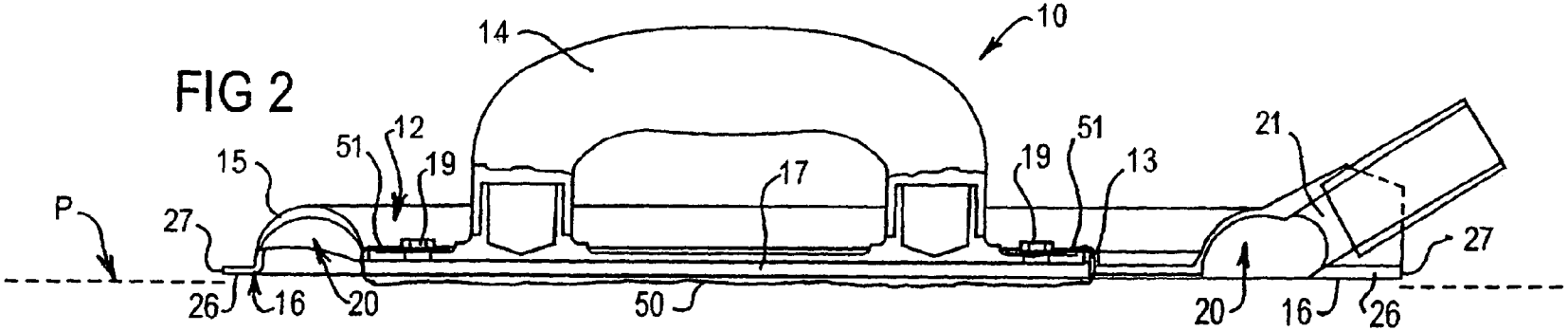
FIG. 2 is a sectional side view of the sanding tool of FIG. 1 along section line (II) (II)

The shroud 12 includes a channel or trough 20 which is formed intermediate the main body portion 13 and the outer edge region 16 of the peripheral wall 15. As best illustrated in FIG. 2, the peripheral wall 15 forms one side of the channel 20. This channel extends around the entire perimeter of the sanding block 11.

The shroud 12 further includes an outlet 21. The outlet 21 is in the form of a tubular coupling which communicates with the channel 20 and which extends upwardly from the plane P of the sanding surface of the sanding tool 10 at an angle of approximately 30 degrees. The outlet 21 is operative to be connected to a source of suction (not shown) such as a vacuum cleaner.

The outlet 21 is disposed adjacent one end of the sanding block. On the opposite end, an air inlet 22 is provided which is formed as a interruption or cut out section formed in the peripheral wall 15. In the illustrated form, the length of this cut out is about 35 mm.

The channel 20 is non uniform in depth. In particular, as best illustrated in FIG. 3, the channel includes a constricted region 23 adjacent the inlet 22. The channel is specifically formed so that it is narrowest in the mid region 24 of the inlet 22 and increases in depth away from the inlet to the portions 25 of the channel which extend along the long side of the sanding block 11. The channel 20 also increases in depth along these portions 25 towards the outlet although this increase in depth is much less marked than that found in the constricted region 23 adjacent the inlet 22.

The outer edge region 16 of the shroud 12 includes a flange 26 which extends outwardly generally in a plane parallel to the sanding plane P. This flange 26 extends about 20 mm to the terminal edge 27 of the shroud. The flange extends around the entire perimeter of this shroud except it is interrupted at the inlet 22.

In operation of the sanding tool 10, a source of suction is applied to the outlet 21. As the sandpaper moves across the surface to be sanded the abraded material generated is caused to be drawn into the channel 20 wherein it is removed through the outlet 21. This occurs as air is drawn from outside across the flange 26 through the clearance formed between the flange and the sanding surface. As mentioned above, this clearance is provided because the sandpiper sits proud of the shroud 12. The perimeter flange 26 assists in preventing from dust escaping through the flange as air is caused to be directed across this surface into the channel 20.

Air is also caused to be drawn in from the air inlet 22. As the air inlet 22 provides a significantly larger opening along a discrete portion of the sander shroud perimeter, a draft is generated at the air inlet. This helps to direct the flow of air through the channel. In particular when the sanding tool 10 is used in overhead sanding, the air flow through the inlet 22 assists in clearing the dust in the channels which would otherwise tend to accumulate in those parts of the channels remote from the outlet 22. The creation of a draft to prevent dust accumulating is further enhanced by the incorporation of the constricted regions which accelerates the passage of air through the inlet and by virtue of its sloping surfaces encourages dust to move into the side portions 25 of the channel 20.

With the combined air flow of effects generated by the flow of air across the flanges 26 and through the inlet 22, the sanding tool is able to efficiently remove substantially all the dust generated by the sander Whether the sanding tool is used as an overhead sander or as a wall sander.

FIGS. 4 and 5 illustrate a modified sanding tool which is designed specifically for sanding internal corners and the like. As this internal sander includes many similar features to the sander 10, like features have been given like reference numerals.

The internal sanding tool 30 differs primarily that it has a front side which enables the abrasive material to be exposed. In the illustrated form, the abrasive material is in the form of an internal sanding block 60 (shown in phantom) rather than a sheet of sandpaper 50 as in the earlier embodiment. Further, the shroud body 13 includes a recess 31 which is operative to receive the sanding block 60 in an interference fit. An outer front surface 61 of the sanding block is designed to project approximately 2 mm or 3 mm from the front edge of the sander. Similarly the lower surface 62 of the sanding block is designed to project below the sander by approximately 2 mm or 3 mm thereby enabling both these front and lower surfaces of the sander to come in contact with the surface to be sanded.

As the sanding tool 30 enables the abrasive material to be exposed, the channel 20 only extends part way round the sanding block 60. With this configuration, the outlet 21 is disposed intermediate the ends 32, 33 of the channel.

Further, the internal sander 30 includes two inlets $22^{i}$ and $22^{ii}$ located at each of the channel ends.

In operation of the internal sander 30, dust generated is caused to be drawn into the channel 20 wherein it can be extracted through the outlet 22. Further, any dust on the front surface 61 of the sanding block is drawn across that surface into the inlet channels $22^{i}$ and $22^{ii}$. Air is also drawn in through the clearance between the flange 25 and the sanding surface. Again the air flow generated by virtue of air travelling across the flange and through the inlets enables substantially all dust to be collected and effectively removed through the outlet.

Accordingly, the present invention provides a sanding tool which includes an improved shroud which enables more efficient air flow around the sanding block to facilitate dust removal. Although the foregoing description relates to manual sanders for use on plaster ceilings and walls, it will be appreciated by those skilled in the art that the novel shroud configuration could be easily adapted for use with electric sanders, such as orbital sanders or the like. In addition, the device may be used in other applications eg for sanding motor vehicles and the like.

It will be appreciated that numerous variations and/or modifications may be made to the parts previously described without departing from the spirit or ambit of the invention.

What is claimed is:

1. A sanding tool for sanding generally planar surfaces, the tool comprising:

a block adapted to receive, or including, an abrasive member;

a shroud including a peripheral wall having an edge region which extends at least part way round said block, the peripheral wall being spaced from said block so that a channel is formed between said block and said peripheral wall which is configured to receive abraded dust generated by said abrasive member, the block being positioned relative to said shroud so that in use, the abrasive member projects beyond said edge region of said peripheral wall;

at least one outlet located in said shroud and communicating with said channel, the at least one outlet being connectable to a source of suction; and at least one air inlet located in said shroud and communicating with said channel, and being oppositely disposed relative to said at least one outlet of said channel the at least one air inlet formed in the said peripheral wall, wherein when the sander is located on a planar surface and suction is applied to the at least one outlet, air is able to be drawn into the channel over said edge region of said peripheral wall, and wherein the at least one inlet is configured to introduce a draft which flows through said channel to facilitate transport of abraded dust through the channel to the at least one outlet.

2. A sanding tool according to claim 1, wherein the channel is formed in said shroud.

3. A sanding tool according to claim 1, wherein the at least one inlet is formed as an interruption in the edge region of said peripheral wall.

4. A sanding tool according to claim 1, wherein the tool is designed for sanding along the internal corner of two mutually inclined planar surfaces, the sanding block being cuboid and including abrasive material on a front and a contiguous side face, the peripheral wall of the shroud extending only part way round said block, so as to leave both said front face and said side face exposed, and wherein the channel includes opposite first and second ends which are disposed on opposite sides of the front face, and wherein a said inlet is disposed at each of said first and second channel ends.

5. A sanding tool according to claim 4, wherein the at least one outlet is disposed in said channel intermediate said first and second ends.

6. A sanding tool according to claim 1, wherein the tool is designed for manual use.

7. A sanding tool according to claim 1, wherein the tool forms part of an electric sanding device, and includes a drive arrangement for moving said abrasive member to facilitate sanding of said surface.

8. A sanding tool for sanding generally planar surfaces, the tool comprising:

a block adapted to receive, or including, an abrasive member;

a shroud including a peripheral wall having an edge region which extends at least part way round said block, the peripheral wall being spaced from said block so that a channel is formed between said block and said peripheral wall which is configured to receive abraded dust generated by said abrasive member, the block being positioned relative to said shroud so that in use, the abrasive member projects beyond said edge region of said peripheral wall;

at least one outlet located in said shroud and communicating with said channel, the at least one outlet being connectable to a source of suction;

at least one air inlet located in said shroud and communicating with said channel, wherein when the sander is located on a planar surface and suction is applied to the at least one outlet, air is able to be drawn into the channel over said edge region of said peripheral wall, and wherein the at least one inlet is configured to introduce a draft though said channel to facilitate clearing of abraded dust from the channel to the at least one outlet; and, wherein the edge region of the peripheral wall includes a flange which extends outwardly in a plane generally parallel to the sanding plane of the tool.

9. A sanding tool according to claim 8, wherein the channel is formed in said shroud.

10. A sanding tool according to claim 8, wherein the at least one inlet is formed as an interruption in the edge region of said peripheral wall.

11. A sanding tool according to claim 8, wherein the tool is designed for manual use.

12. A sanding tool according to claim 8, wherein the tool forms part of an electric sanding device, and includes a drive arrangement for moving said abrasive member to facilitate sanding of said surface.

13. A sanding tool for sanding generally planar surfaces, the tool comprising:

a block adapted to receive, or including, an abrasive member;

a shroud including a peripheral wall having an edge region which extends at least part way round said block, the peripheral wall being spaced from said block so that a channel is formed between said block and said peripheral wall which is configured to receive abraded dust generated by said abrasive member, the block being positioned relative to said shroud so that in use, the abrasive member projects beyond said edge region of said peripheral wall;

at least one outlet located in said shroud and communicating with said channel, the at least one outlet being connectable to a source of suction;

at least one air inlet located in said shroud and communicating with said channel, wherein when the sander is located on a planar surface and suction is applied to the at least one outlet, air is able to be drawn into the channel over said edge region of said peripheral wall, and wherein the at least one inlet is configured to introduce a draft through said channel to facilitate clearing of abraded dust from the channel to the at least one outlet; and, wherein the depth of said channel decreases in the vicinity of the at least one inlet to form a constricted region at that inlet.

14. A sanding tool according to claim 13, wherein the at least one inlet intersects the channel and wherein the channel depth increases in both directions from said inlet.

15. A sanding tool according to claim 13, wherein the channel is formed in said shroud.

16. A sanding tool according to claim 13, wherein the at least one inlet is formed as an interruption in the edge region of said peripheral wall.

17. A sanding tool according to claim 13, wherein the tool is designed for manual use.

18. A sanding tool according to claim 13, wherein the tool forms part of an electric sending device, and includes a drive arrangement for moving said abrasive member to facilitate sanding of said surface.

19. A sanding tool for sanding generally planar surfaces, the tool comprising:

a block adapted to receive, or including, an abrasive member;

a shroud including a peripheral wall having an edge region which extends at least part way round said block the peripheral wall being spaced from said block so that a channel is formed between said block and said peripheral wall which is configured to receive abraded dust generated by said abrasive member, the block being positioned relative to said shroud so that in use, the abrasive member projects beyond said edge region of said peripheral wall;

at least one outlet located in said shroud and communicating with said channel, the at least one outlet being connectable to a source of suction;

at least one air inlet located in said shroud and communicating with said channel, wherein when the sander is located on a planar surface and suction is applied to the at least one outlet, air is able to be drawn into the channel over said edge region of said peripheral wall, and wherein the at least one inlet is configured to introduce a draft through said channel to facilitate clearing of abraded dust from the channel to the at least one outlet, and wherein the block is rectangular in cross section and the channel extends around the entire perimeter of said block, and wherein the at least one outlet is disposed adjacent one side of said block, and wherein the at least one inlet is disposed adjacent an opposite side of said block.

20. A sanding tool according to claim 11, wherein the channel is formed in said shroud.

21. A sanding tool according to claim 11, wherein the at least one inlet is formed as an interruption in the edge region of said peripheral wall.

22. A sanding tool according to claim 19, wherein the tool is designed for manual use.

23. A sanding tool according to claim 19, wherein the tool forms part of an electric sanding device, and includes a drive arrangement for moving said abrasive member to facilitate sanding of said surface.

* * * * *